United States Patent [19]

Vainikka

[11] 4,431,239

[45] Feb. 14, 1984

[54] PIVOT MEANS

[76] Inventor: Matti Vainikka, 41800 Vaajakoski, Finland

[21] Appl. No.: 243,074

[22] Filed: Mar. 12, 1981

[30] Foreign Application Priority Data

Oct. 1, 1980 [FI] Finland ..... 803120

[51] Int. Cl.[3] ..... A47B 27/02

[52] U.S. Cl. ..... 312/231; 108/1; 312/196; 312/326

[58] Field of Search ..... 312/231, 233, 230, 196, 312/326, 325; 108/1, 9, 8

[56] References Cited

U.S. PATENT DOCUMENTS

| | | | |
|---|---|---|---|
| 346,795 | 8/1886 | Wilcox | 312/325 |
| 1,409,026 | 3/1922 | Rawls | 312/196 |
| 1,652,774 | 12/1927 | Fraser et al. | 312/233 |
| 1,853,526 | 4/1932 | Wetmore et al. | 108/8 |
| 2,272,819 | 2/1942 | Poetsch et al. | 312/233 |
| 2,931,685 | 4/1960 | Butler | 312/196 |
| 3,307,603 | 3/1967 | Swett | 312/284 |
| 3,698,327 | 10/1972 | Litvinoff et al. | 108/6 |
| 3,980,266 | 9/1976 | Jones | 312/233 |
| 4,047,774 | 9/1977 | Hanning | 108/8 |
| 4,196,674 | 4/1980 | Van Laarhoven | 108/9 |

FOREIGN PATENT DOCUMENTS

| | | | |
|---|---|---|---|
| 278879 | 11/1951 | Switzerland | 312/196 |
| 367952 | 4/1963 | Switzerland | 108/9 |

*Primary Examiner*—Victor N. Sakran

*Attorney, Agent, or Firm*—Andrus, Sceales, Starke & Sawall

[57] ABSTRACT

The invention relates to a pivot means for a desk top. Said means of the invention comprises two arm members whose first ends are articulated to the desk body and which are both fitted with a flange bearing against the desk body for supporting the arm members inclined towards the front edge of the top. The top is articulated to the opposite ends of said arm members by means of said arm members connecting pin in such a manner that the top rear edge can be erected on the vertically supported arm members and lowered down by moving the top onto the arm members pivoted towards the rear edge of the desk body. The bottom face of the top near the front edge of the top can be provided with a locking groove corresponding to a shoulder-shaped retainer formed in the desk body for locking the top on the desk body in the front-edge direction.

3 Claims, 3 Drawing Figures

PIVOT MEANS

The present invention relates to a pivot means for pivotably connecting the top of a desk or working table at its rear edge to the body of a desk so as to be turnable in vertical direction for opening the top by lifting up its front edge. The invention particularly concerns a pivot means intended for a pupil's or student's desk.

BACKGROUND OF THE INVENTION

There are known conventional pivot devices for desks whose tops are inclined according to the body. Such a top can be opened by lifting up the top front edge, said top being articulated to turn backwards by the pivot means. Also known are desks whose tops are horisontal with the rear edge articulated by means of a conventional pivot means the same way as the above-mentioned conventional desk tops. Neither of these conventional desks or pivot means provides for positioning the desk top both in inclined and horisontal position as desired, in other words, the position of the desk top cannot be adjusted by means of known pivot devices.

Presently, there is need to develop a pivot means for the top of a desk, particularly that of a student's desk, which pivot means would provide for ergonomic working, i.e. adjustment of the top in inclined and horisontal position as it may be desired. This need is particularly evident with school children who must use desks for years, possibly well over ten years, as they simultaneously go through a rapid growing period setting especially strict requirements for ergonomic working, since wrong working positions will later lead to perhaps difficult carriage and skeleton damages.

SUMMARY OF THE INVENTION

The object of the present invention is to eliminate the above drawbacks. The object of the invention is especially to provide a pivot means for a desk, particularly for a school desk, in such a manner that said pivot means provides for the adjustment or setting of the desk top for ergonomic working.

DESCRIPTION OF THE DRAWINGS

Hereinbelow the invention is described in detail by means of a work example with reference made to the accompanying drawings, in which.

DESCRIPTION OF THE PREFERRED EMBODIMENT

Figure 1:
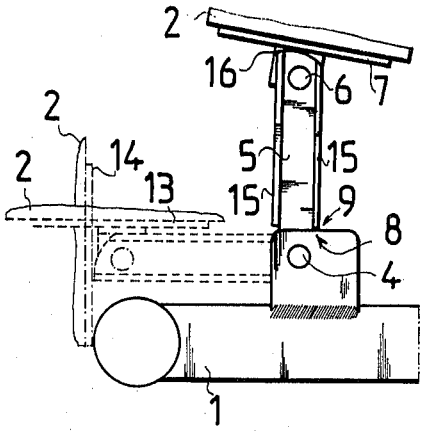
FIG. 1 is a side view of a pivot means of the invention for aschool desk in positions corresponding to various top positions.

FIG. 1 shows in side view a pivot means according to the invention for pivoting a desk top 2 to the desk body 1 so as to be pivotable in vertical direction. The pivot means is intended for opening the top 2 by lifting up its front edge (in the right side in figure).

According to the invention, the pivot means comprises two arm members 5 which are laterally aligned and articulated 4 to the body 1; there is just one arm member visible in the figure, the other being covered by the first one. The arm members 5 are articulated by means of a conventional pin joint 4 for free rotation in the pivoting direction of top 2 in the direction of the top rear edge and each of them is also fitted with a flange 8 which bears against the bracket element 9 of the body 1 in order to support the vertically positioned arm member in inclination towards the top front edge. The top 2 is pivotably mounted on the opposite ends of arm members. The top rear edge can thus be lifted up on the vertically supported arm members as well as lowered down by moving the top towards its rear edge onto the arm members which are pivotable onto the body; the arm members 5, as pivoted on the body 1, are shown in dashed lines in FIG. 1 and solid lines in FIG. 2.

Figure 2:
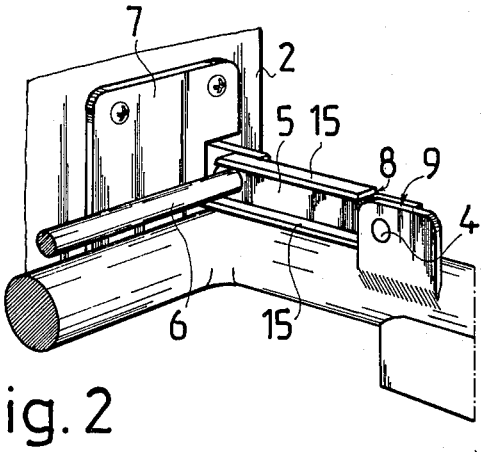
FIG. 2 shows the pivot means of FIG. 1 in perspective view with the open and lifted in vertical position.

In the embodiment of FIGS. 1 and 2, the top 2 is articulated to said arm members 5 for free rotation in the direction of the front edge of the top. Each arm member 5 is fitted with an abutment means or stopper 16 (visible in FIG. 1) which bears against the top 2 when turning the opened top backwards as well as limits the pivoting of the top with respect to the arm members. Thus, the abutment means 16 provides for the turning of the arm members, which are articulated to the body 1 for free rotation towards the top rear edge, in the direction of the rear edge of the top and onto the body 1 along with the movement of the top as the front edge of the opened top is further lifted. Hence, the top 2 is lifted in completely vertical position, said arm members 5 fall together with the top against the body and the top opens in straight vertical direction, shown in dashdot lines in FIG. 1. Thereafter, the front edge of the top 2 can be relowered, whereby the top lies in the horizontal position, shown by dashed lines in FIG. 1. If relifting of the top rear edge is desired, this can be effected by lifting the top at the joint pin 6 so that the arm member erects, as shown by solid lines in FIG. 1, the arm member being supported towards the top front edge in inclined position with the flange 8 bearing against the abutment face 9 of the body 1.

Figure 3:
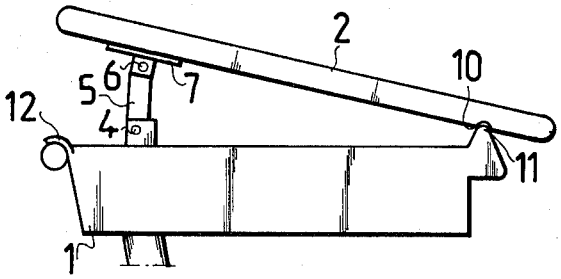
FIG. 3 shows a desk fitted with the pivot of FIGS. 1 and 2, the lower portion or the body being partly omitted.

FIG. 3 shows the arrangement of one embodiment of the invention locking the top 2 in a inclined working position. The lower face of top 2, near the top front edge, is provided with a locking groove 10 running crosswise of the top or parallel to pin 6 and the body 1 is provided with a shoulder-shaped retainer 11 corresponding and parallel to the locking groove, which retainer is fitted to be received in the locking groove when the top rear edge is supported up on the arm members 5. Thus, the top is locked in position in its front edge-rear edge-direction by virtue of said locking groove 10 and retainer 11.

In the embodiment of the invention shown in FIGS. 1 to 3, the arm members 5 are formed of U-shaped steel profile comprising a flange portion and two hems 15. The lower end of hem 15 of the arm section 5 facing the front edge of top 2 provides a flange 8, and the upper face of an upwardly extending bracket formed in the tubular body of frame of a desk provides a corresponding abutment face 9. The arm member 5 is articulated to a mounting bracket extending downwards from a sheet-shaped mounting element 7 secured to the top 2 by screws by means of a pivot pin 6. The end of the arm member's 5 hem facing the rear edge of top 2 provides an abutment 16 on which the sheet-shaped mounting element 7 secured to top 2 is supported when the top is lifted completely open and the arm members lowered into the lower position on the body 1. In this lower position, the lower face of the rear edge of top 2 suitably bears against a pad 12 disposed on the front edge of the desk drawer, said pad also absorbing the impact caused by suddenly pushing the top from the upper position (shown in FIG. 3) to the lower position.

The examples are intended to depict the invention without restricting it in any way.

I claim:

1. A construction for pivotally connecting the rear edge of a desk top to a desk body, comprising a pair of laterally aligned arms, corresponding first ends of said arms being pivotally connected to said body and corresponding second ends of said arms being pivotally connected to said top, said arms being pivotable in vertical planes from a first position in which each arm is in a generally upright position and the arms support the rear edge of said top in an inclined position to a generally horizontal position where the top is in a horizontal condition, an abutment disposed on at least one of said arms to support the arms in a genrally upright position, lifting on the rear edge of the top when in the horizontal position causing said arms to pivot forwardly to the upright position to support the top in an inclined position and a second abutment on at least one of said arms and disposed to bear against the undersurface of the desk top when the arms are in the generally upright position to limit pivotal movement of the desk top with respect to said arms in a direction toward the front edge of said desk top.

2. The construction of claim 1, and including an elongated pin pivotally interconnecting the second ends of the arms.

3. A construction for pivotally connecting the rear edge of a desk top to a desk body, comprising a pair of laterally aligned arms, corresponding first ends of said arms being pivotally connected to said body and corresponding second ends of said arms being pivotally connected to said top, said arms being pivotable in vertical planes from a first position in which each arm is in a generally upright position and the arms support the rear edge of said top in an inclined position to a generally horizontal position where the top is in a horizontal condition, and an abutment disposed on at least one of said arms to support the arms in a generally upright position, lifting on the rear edge of the top when in the horizontal position causing said arms to pivot forwardly to the upright position to support the top in an inclined position, the bottom surface of the desk top being provided with a laterally extending groove adjacent the front edge of the desk top, and said body being provided with a laterally extending retainer rib disposed to mate with the groove when said arms are in the upright position to thereby maintain the desk top in the inclined condition.

* * * * *